US008251216B1

(12) United States Patent
Liao

(10) Patent No.: US 8,251,216 B1
(45) Date of Patent: Aug. 28, 2012

(54) GAS COLUMN STRUCTURE FOR SHOCKPROOF SLEEVE

(76) Inventor: Yaw Shin Liao, New Taipei (TW)

( * ) Notice: Subject to any disclaimer, the term of this patent is extended or adjusted under 35 U.S.C. 154(b) by 0 days.

(21) Appl. No.: 13/048,873

(22) Filed: Mar. 16, 2011

(51) Int. Cl.
*B65D 81/02* (2006.01)

(52) U.S. Cl. ..... 206/522

(58) Field of Classification Search ..... 206/521, 206/522, 320, 701, 722, 723; 383/3
See application file for complete search history.

(56) References Cited

U.S. PATENT DOCUMENTS 5,340,632 A * 8/1994 Chappuis ..... 428/71
6,755,568 B2 * 6/2004 Malone et al. ..... 383/3
2008/0159659 A1 * 7/2008 Liao et al. ..... 383/3
2008/0197041 A1 * 8/2008 Jian ..... 206/522
2008/0314783 A1 * 12/2008 Yoshifusa ..... 206/522
2009/0050509 A1 * 2/2009 Liao et al. ..... 206/522
2009/0050510 A1 * 2/2009 Kojima et al. ..... 206/522
2010/0072103 A1 * 3/2010 Watanabe et al. ..... 206/522

* cited by examiner

*Primary Examiner* — Jacob K Ackun

(57) ABSTRACT

A gas column structure for a shockproof sleeve includes a gas-column sheet, two folding lines and two recessed buffer walls. Each of the recessed buffer walls has U-shaped members formed abreast through heat sealing. The middle short gas columns of the U-shaped members at two sides of the recessed buffer walls are unfilled, so that four corners of the gas column structure for the shockproof sleeve are free from being broken when contacting sharp points. The gas columns of the gas-column sheet may be formed through heat sealing to have irregular shapes, so the gas-column sheet is ideal for articles with sharp points and/or irregular shapes. A dark screen may be additionally provided for covering the accommodating space as a movable screen that covers and thereby protects the semi-open accommodating space.

12 Claims, 7 Drawing Sheets

GAS COLUMN STRUCTURE FOR SHOCKPROOF SLEEVE

BACKGROUND OF THE INVENTION

1. Technical Field

The present invention relates to shockproof sleeves for electronic products, and more particularly, to a gas column structure for a shockproof sleeve.

2. Description of Related Art

Shockproof sleeves are extensively used to wrap and protect electronic products, such as projectors, DVD, digital cameras, laptop computers and mobile phones. The electronic products in early times were rarely provided with display screens and even those with screens had relatively small screens. However, the trend for modern portable electronic products, such as mobile phones and game players, is that the screens equipped are increasingly enlarged. In the event that these modern portable electronic products get impacted at the screens, the screens are likely to be damaged and then the whole electronic products become unusable. Thus, shockproof sleeves have been developed with increasingly launched portable electronic products, such as those for mobile phones, digital cameras, and particularly, for laptop computers, so as to prevent electronic products from being damaged when they are being carried with people.

Traditionally, shockproof sleeves are designed as simple packaging. A conventional shockproof sleeve is typically a plastic sheet formed with a plurality of small raised air bubbles. In use, the shockproof sleeve wraps an article to be protected for absorbing shake and buffing. However, those small air bubbles have only limited shock-absorbing capability and may fail to provide shockproof and buffing effects against heavy shock or impact. Such a shockproof sleeve is typically made of EVA, which is an environmentally friendly plastic foaming material, and provides excellent shockproof and waterproof functions, while being antiseptic, non-toxic, non-pollutant and safe. However, in view that EVA is relatively costly, air-filled packaging bags have been developed as a new packaging and buffing material.

For example, there is a vertical hammock type air shockproof sleeve on the market for packing and protecting articles. Such an air shockproof sleeve is formed with a plurality of gas columns and a plurality of folding nodes. The gas columns are arranged along the folding nodes to form a base and buffer portions at two sides of the base with an accommodating space defined between the base and the buffer portions. The air shockproof sleeve further has at least one buffer sheet that has its two sides connected to the buffer portions and suspends in the accommodating space. However, when an article is received in the accommodating space, the article is not tightly close to the buffer portions and tends to shake and rock in the accommodating space, so the sleeve can get pierced by sharp corners or hardware joints of the article. Once the sleeve is broken, air filled therein will leak out and the article losing protection may be impacted or scraped.

Another example is a hammock type air shockproof sleeve, which has a first buffer wall and a second buffer wall formed with a first node and a second node, respectively. After the first buffer wall is bent against the first node and the second buffer wall is bent against the second node, the first buffer wall has its first edge bound with a second edge of the second buffer wall by neat sealing, so that an accommodating space is formed between the first buffer wall and the second buffer wall. A buffer sheet suspends in the accommodating space for wrapping an article to be protected and preventing the article from shaking, while the first buffer wall and the second buffer wall protect the article as well. Although there are two buffer walls, namely the first buffer wall and the second buffer wall, the accommodating space is not flat-bottomed, so when the article is placed at the edges near where the nodes are formed, the article having its weight pressing on the gas columns may pierce the gas columns to cause air leakage. As a result, the air shockproof sleeve will lose its protective function.

Taiwan Patent Application No. 200740667, titled as "Gas-filled packing bag with multiple auxiliary gas columns" has disclosed a packing bag composed of a plurality of gas column sets. Each said set includes a main gas column relatively larger in width and a first as well as a second auxiliary gas column relatively small in width. Particularly, the main gas column has a width 1-2 cm larger than that of the first and second auxiliary gas column. Between the main gas column and the first auxiliary gas column, and between the first auxiliary gas column and the second auxiliary gas column, there are heat sealing lines defining the gas columns as individuals. Along each of the heat sealing lines, one transverse channel is formed every 10-15 cm for air communication between the main gas column and the first or second auxiliary gas column while no such channel is provided along the heat sealing line between two adjacent gas column sets. Thus, the gas column sets are independent of each other without air communication therebetween. Thereby, breakage and gas leakage of the main gas column and/or the auxiliary gas columns of one gas column set will not affect the airtightness of other gas column sets. When the bag receives significant impact, gas will travel from the main gas column through the channel to the first auxiliary gas column, and then travel form the first auxiliary gas column through the channel to the second auxiliary gas column, vice versa, until the pressure balance is established among the auxiliary gas columns and the main gas column. In virtue of the plural auxiliary gas columns, the capacity of the main gas column is enhanced, and the shockproof ability of the packing bag is improved. While the prior-art gas-filled packing bag with multiple auxiliary gas columns is capable of bearing heavy impact, it is not suitable for packing articles with sharp points and it fails to propose a solution for the folds at the corners of the bag caused by bent gas columns.

SUMMARY OF THE INVENTION

A first objective of the present invention is to provide a gas column structure for a shockproof sleeve, which holds an articles in an accommodating space firmly, so as to prevent the article from shaking and rocking to have its sharp corners or hardware joints piercing a gas-column sheet and recessed buffer walls of the shockproof sleeve and cause air filled to leak out and fail. The gas-column sheet and the two recessed buffer walls form a semi-open accommodating space, and the recessed buffer walls located at two sides of the gas-column sheet can be everted upon folding lines by an external force. After an article is placed in the opened accommodating space and the external force is removed, the recessed buffer walls returns automatically, so as to hold the article in the accommodating space firmly. Thereby, the article during transportation is retained from shaking or rocking to pierce the gas-column sheet and the recessed buffer walls.

A second objective of the present invention is to provide the gas column structure for the shockproof sleeve, wherein the gas column structure has improved strength so as to better protect the article in the accommodating space from overturning and ensure sharp points of the article not to contact gas columns of the gas-column sheet and the two recessed buffer walls directly. The reason is that when the article is placed into the accommodating space of the gas column structure for the shockproof sleeve, the gas-column sheet serves to carry the article and allow the article to lie levelly on the gas-column sheet, so the gas columns of the gas-column sheet and the two recessed buffer walls can evenly share the weight of the article, so as to prevent the weight from focusing on one point and breaking the gas column.

A third objective of the present invention is to provide the gas column structure for the shockproof sleeve, wherein corners of the gas column structure for the shockproof sleeve are secured from being damaged an losing their buffing function. The middle short gas columns of the U-shaped members at two sides of the recessed buffer walls are unfilled, so that four corners of the gas column structure for the shockproof sleeve are free from being broken when contacting sharp points, thereby ensuring buffing effects of the corners of the shockproof sleeve.

A fourth objective of the present invention is to provide the gas column structure for the shockproof sleeve, wherein each of the U-shaped members of each of the two recessed buffer walls has a terminal formed as a node, and after plural said U-shaped members are connected abreast through heat sealing into one said recessed buffer wall, the nodes form a second folding line and an additional gas-column sheet is connected to each of the second folding lines, the additional gas-column sheets being configured to be pulled down and positioned above the accommodating space to allow the shockproof sleeve to provide double protection.

A fifth objective of the present invention is to provide the gas column structure for the shockproof sleeve, wherein a dark screen is additionally provided for covering the accommodating space, and the dark screen maybe realized by an additional dark gas-column sheet that is attached to any of the recessed buffer walls of the gas columns by means of heat sealing, so that the dark gas-column sheet serves as a moveable screen that covers and thereby protects the semi-open accommodating space.

A sixth objective of the present invention is to provide the gas column structure for the shockproof sleeve, wherein the shockproof sleeve is especially suitable for articles with sharp ends or of irregular shape because the gas columns are gas-column sheet are formed into irregular shapes when arranged into connected, abreast said gas columns through heat sealing, so that the gas columns are less likely to be pricked by any sharp point of an article received in the shockproof sleeve and that sites where sealing lines are formed are depressed from two adjacent gas columns and ideal to receive the sharp points, thereby holding the article firmly in the accommodating space.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
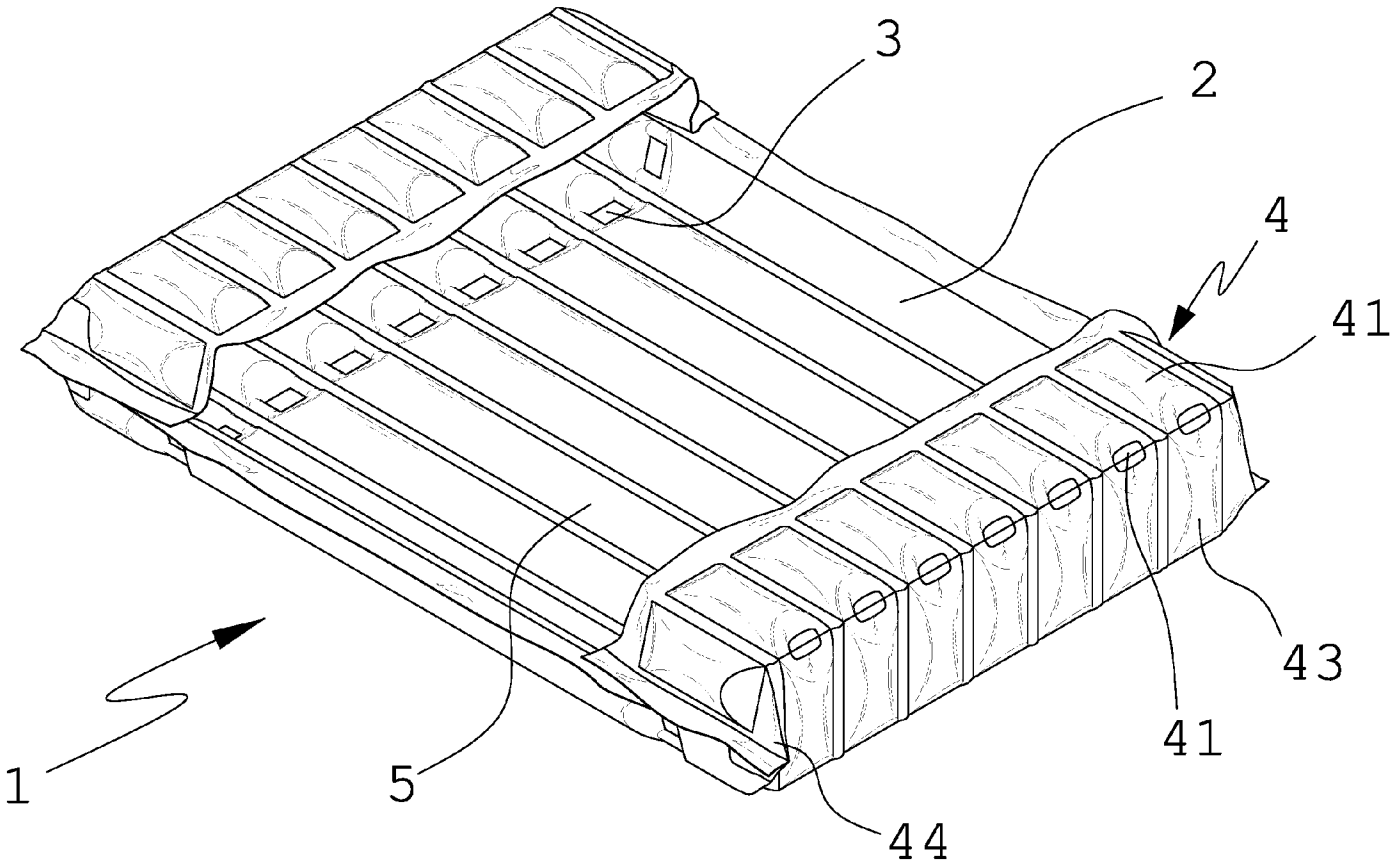
FIG. 1 is a perspective view of the present invention according to a first embodiment.
Figure 2:
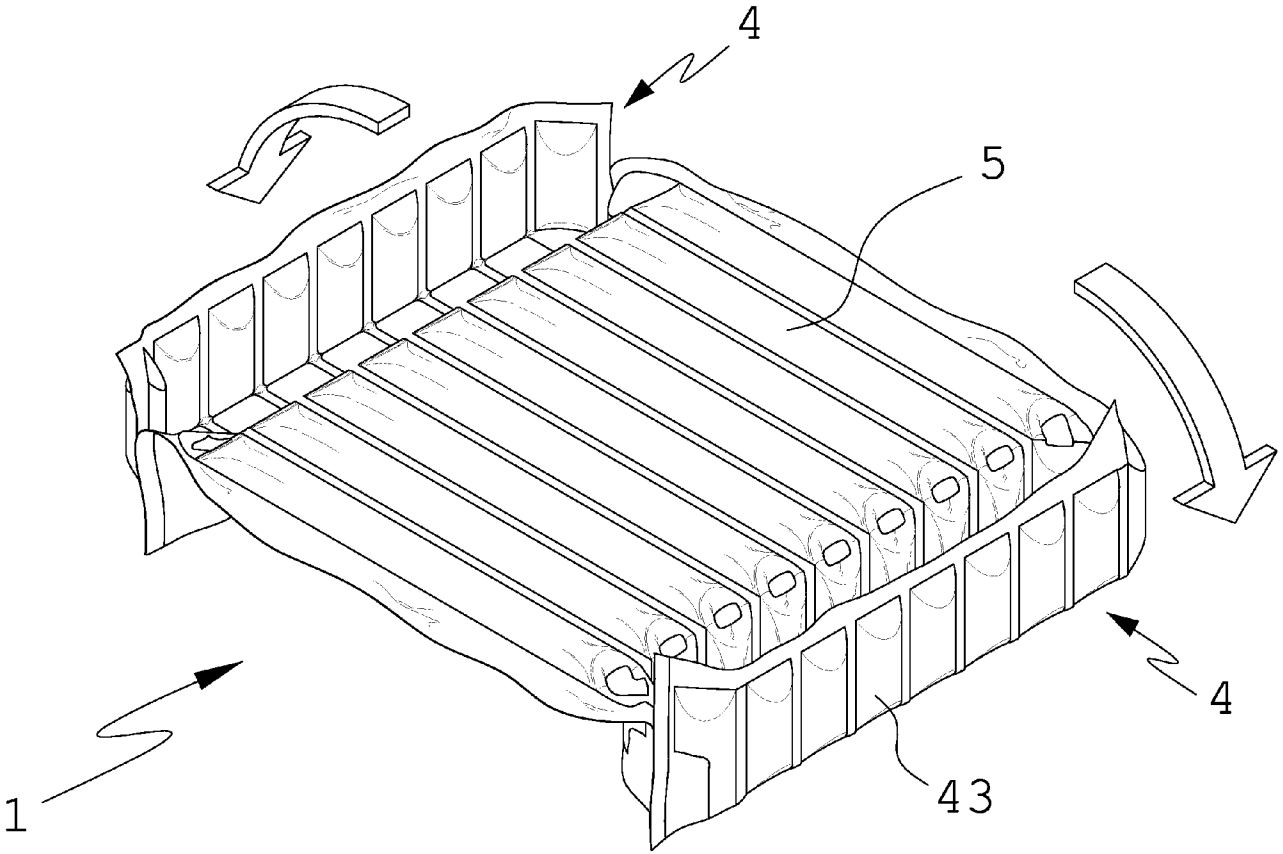
FIG. 2 is a first applied view of the first embodiment.
Figure 3:
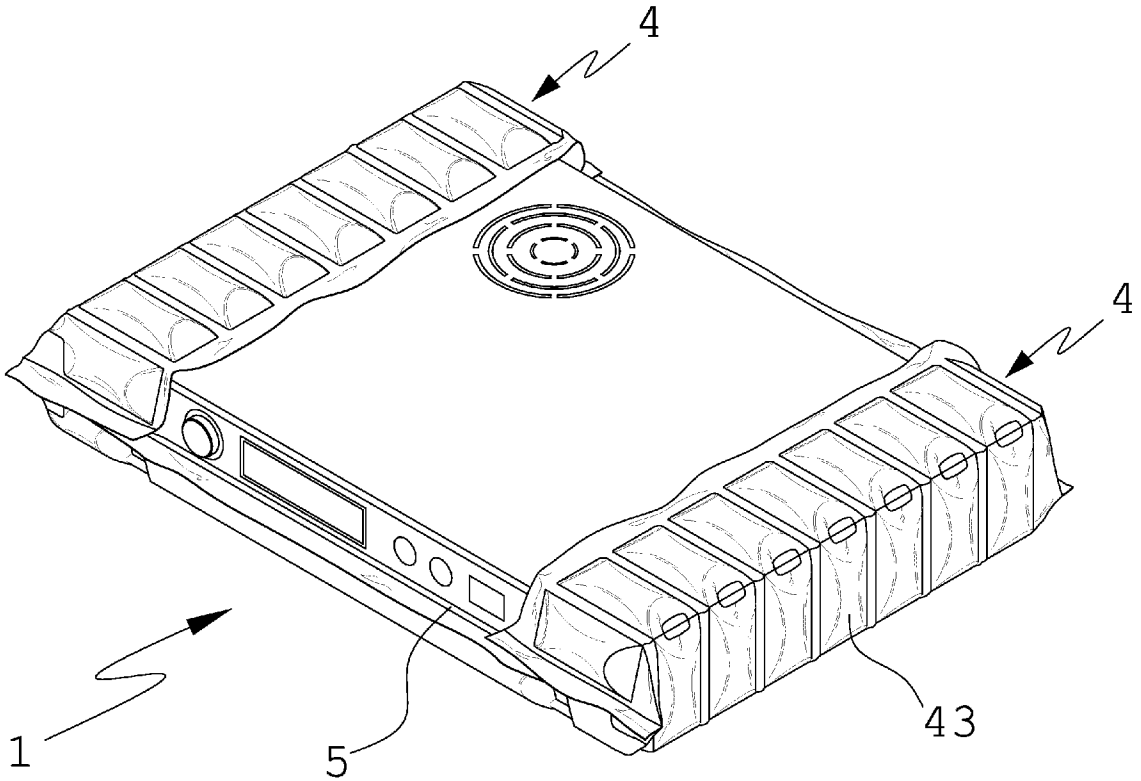
FIG. 3 is a second applied view of the first embodiment.
Figure 4:
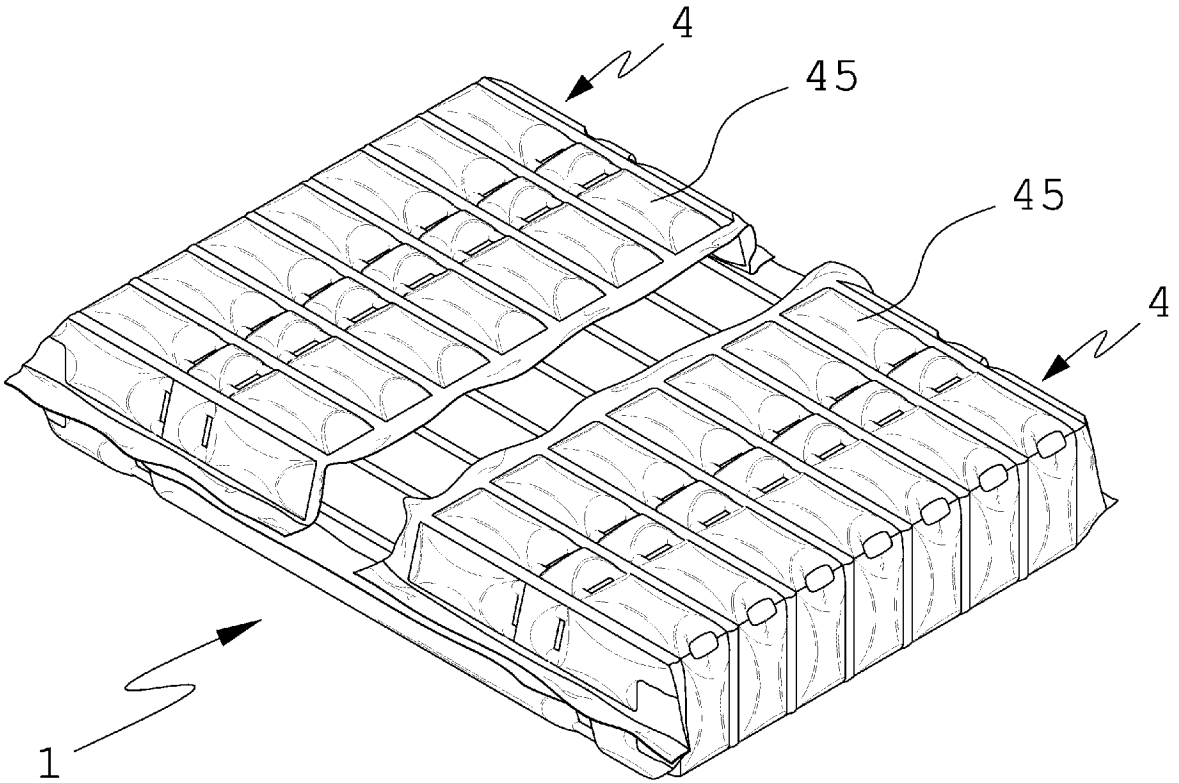
FIG. 4 is a perspective view of the present invention according to a second embodiment.
Figure 5:
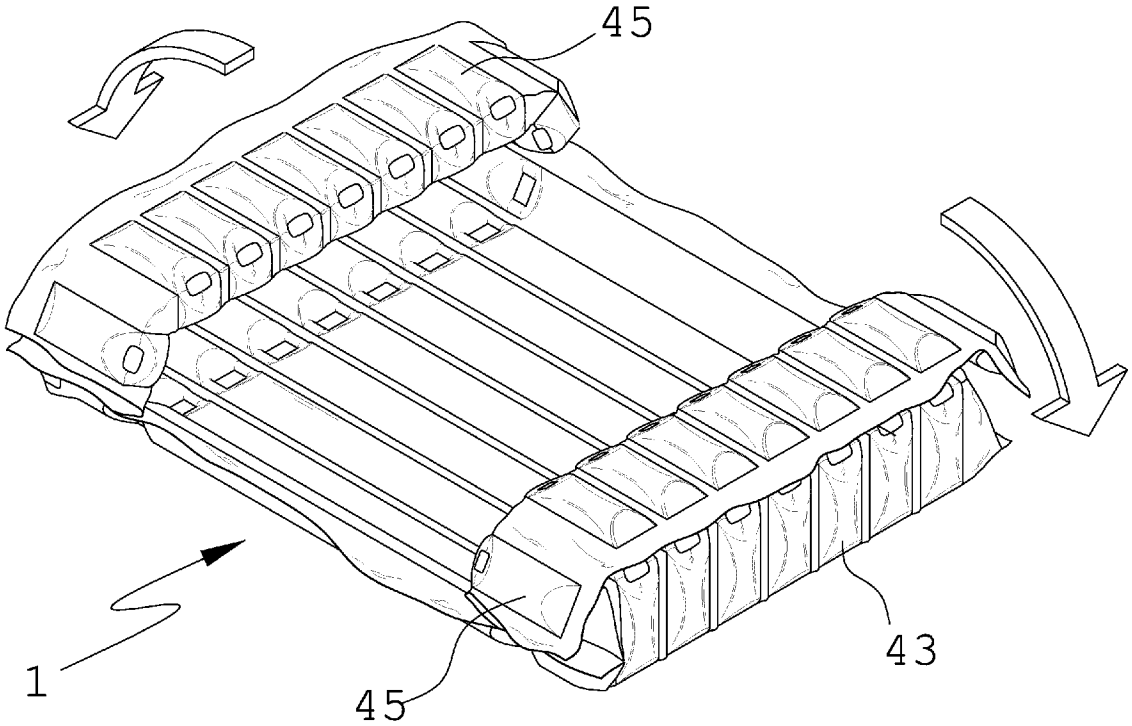
FIG. 5 is an applied view of the second embodiment.

First, please refer to FIG. 1, FIG. 2, FIG. 3, FIG. 4 and FIG. 5, for a perspective view of the present invention according to a first embodiment, a first applied view of the first embodiment, a second applied view of the first embodiment, a perspective view of the present invention according to a second embodiment, and an applied view of the second embodiment.

As shown clearly in the drawings, a gas column structure for a shockproof sleeve 1 is composed of a gas-column sheet 2, two folding lines 3 and two recessed buffer walls 4.

The gas-column sheet 2 includes a plurality of gas columns formed and arranged abreast through heat sealing for receiving an article to be protected.

Each of the two folding lines 3 is composed of a plurality of folding nodes. The number of the folding nodes is equal to the number of the gas columns of the gas-column sheet 2 and the number of adjacent U-shaped members 43. The folding lines 3 are such connected to two ends of the gas-column sheet 2 that the folding lines 3 are perpendicular to gas columns of the gas-column sheet 2.

The two recessed buffer walls 4 are connected to the folding lines 3, respectively. Each of the recessed buffer walls 4 is composed of plural said U-shaped members 43 connected abreast through heat sealing. Each of the U-shaped members 43 is composed of three short gas columns 41 and two nodes 42 alternately connected in series. Each two adjacent said short gas columns 41 are heat sealed together with a said node 42 therebetween. The middle short gas columns 41 of the U-shaped members 43 at two sides of the recessed buffer walls 4 are unfilled, so that four corners 44 of the gas column structure for the shockproof sleeve 1 are free from being broken when contacting sharp points. The number of the gas columns of the gas-column sheet 2 is equal to the number of the adjacent U-shaped members 43, so a semi-open accommodating space 5 is formed between the gas-column sheet 2 and the two recessed buffer walls 4. When receiving an external force, the recessed buffer walls 4 can be everted against the folding lines 3 and allow an article to be placed into the accommodating space 5. After the external force is removed, the recessed buffer walls return automatically to hold the article in the accommodating space 5.

As to the two recessed buffer walls 4, by applying an external force to the nodes 42 of the U-shaped members 43, the U-shaped members 43 can have their openings adjusted in size and shape. Each of the U-shaped members 43 has a terminal formed with a node 42. When the plural U-shaped members 43 are arranged abreast into one said recessed buffer wall 4, the nodes 42 forms a second folding line 3. On the second folding line 3, an additional gas-column sheet 45 may be heat sealed. The additional gas-column sheet 45 has gas columns whose number is equal to the number of the adjacent U-shaped member 43. By pulling the additional gas-column sheet 45 down to the recessed buffer walls 4, the gas column structure for the shockproof sleeve 1 can provide double protection.

Figure 6:
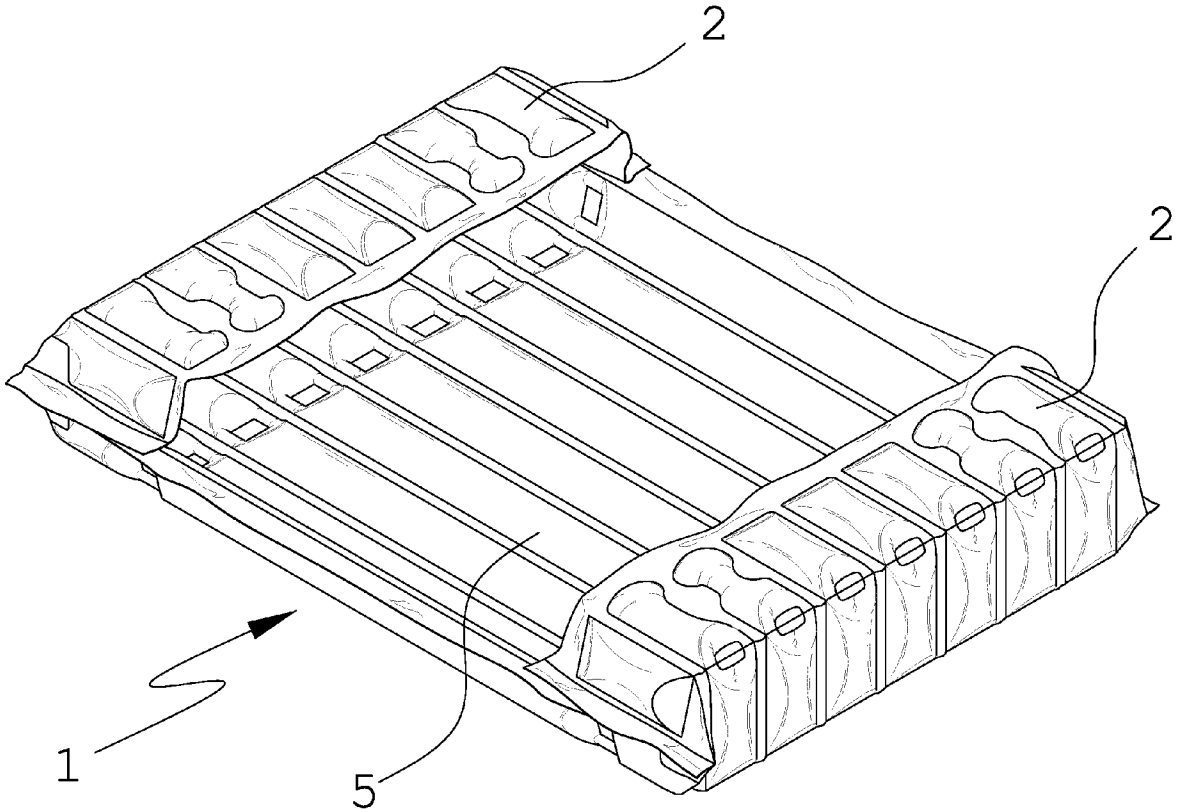
FIG. 6 is a perspective view of the present invention according to a third embodiment.
Figure 7:
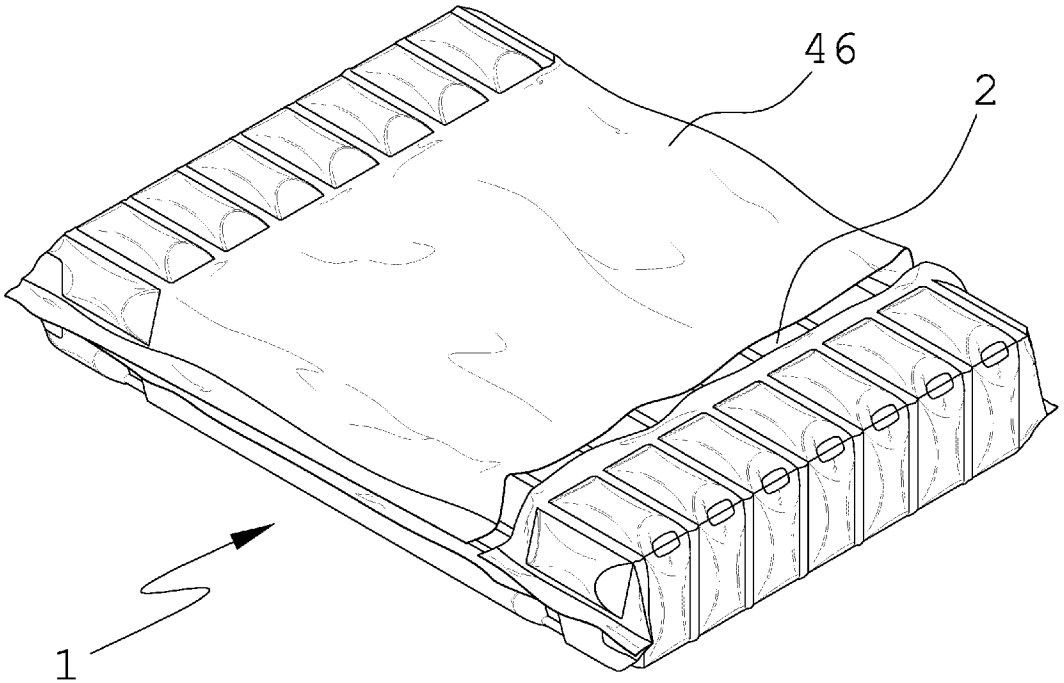
FIG. 7 is a perspective view of the present invention according to a fourth embodiment.

In addition, referring to FIG. 6 and FIG. 7, a third embodiment and a fourth embodiment of the present number are depicted. As shown, a column structure for a shockproof sleeve 1 according to the present invention is useful in packing or wrapping various articles, either symmetrical or asymmetrical in shape. Particularly, it is useful in receiving articles with sharp points or having irregular contours. For manufacturing the gas-column sheet 2, during the process of forming the gas columns abreast through heat sealing, the plural gas columns may be such sealed that they have irregular shapes, so that at least some of the gas columns will not be easily contacted and therefore pricked by sharp points of an article received in the gas-column sheet 2. On the other hand, sites where sealing lines are formed are depressed from two adjacent gas columns and ideal to receive the sharp points and thereby hold the article firmly in the accommodating space 5. Furthermore, a dark screen may be arranged over the shockproof sleeve 1 for covering the accommodating space. The dark screen may be another gas-column sheet 46 with a dark color that is attached to any of the two recessed buffer walls formed by the gas columns by means of heat sealing, so as to act as a movable screen that covers and therefore protects the semi-open accommodating space 5.

The gas column structure for the shockproof sleeve 1 of the present invention can eliminate shake or impact during transportation so as to prevent the sleeve from being pierced by sharp corners or hardware joints of the article it protects and thereby secure the article from impact or scrape. It also prevents the article from having its weight focused on the gas columns and thus breaking the gas columns to cause air leakage and loses its protective function. In addition, the middle short gas columns 41 of the U-shaped members 43 at the two sides of the recessed buffer walls 41 are unfilled, so that the middle short gas columns 41 are protected from being broken when contacting anything sharp, thereby ensuring the buffing effect of the corners 44 of the sleeve 1. Furthermore, the additional gas-column sheets 45 may be attached to the two recessed buffer walls 4 to provide double protection. The use thereof is described below.

In use of the gas column structure for the shockproof sleeve 1 of the present invention, an external force is applied to evert the recessed buffer walls 4 against the folding lines 3, and an article to be placed is placed in the accommodating space 5. After the external force is removed, the recessed buffer walls 4 return automatically to hold the article in the accommodating space 5, so that the gas-column sheet 2 and the recessed buffer walls 4 protects the article in the accommodating space 5. In addition, the additional gas-column sheets 45 attached to the recessed buffer walls 4 at the folding lines 3 can be pulled down to the recessed buffer walls 4 to make the shockproof sleeve provide double protection. Thus, the corners 44 of the gas column structure for the shockproof sleeve 1 are endurable to external impact.

What is claimed is:

1. A gas column structure for a shockproof sleeve, comprising a gas-column sheet, two folding lines and two recessed buffer walls:

the gas-column sheet comprising a plurality of gas columns formed and arranged abreast through heat sealing for carrying an article to be protected;

the two folding lines each comprising a plurality of folding nodes and such connected to two sides of the gas-column sheet that the folding lines are perpendicular to the gas columns of the gas-column sheet;

the two recessed buffer walls each connected to the folding lines, and comprising a plurality of U-shaped members arranged abreast through heat sealing, each U-shaped member comprising three short gas columns and two nodes alternately connected in series, the middle short gas column of each said U-shaped member at a side of each said recessed buffer wall being unfilled, so that four corners of the gas column structure for the shockproof sleeve are protected from being broken when contacting anything sharp, the gas-column sheet and the two recessed buffer walls forming a semi-open accommodating space, the recessed buffer walls being configured to be everted against the folding lines when receiving an external force, so as to allow an article to be placed in the accommodating space and after the external force is removed, the recessed buffer walls automatically return to hold the article in the accommodating space.

2. The gas column structure for the shockproof sleeve of claim 1, wherein in each of the two folding lines, the number of the folding nodes is equal to the number of the gas columns of the gas-column sheet and the number of the adjacent U-shaped members.

3. The gas column structure for the shockproof sleeve of claim 1, wherein each of the U-shaped members of each of the two recessed buffer walls has a terminal formed with a node, and after plural said U-shaped member are formed and arranged abreast through heat sealing into one said recessed buffer wall, the nodes form a second folding line.

4. The gas column structure for the shockproof sleeve of claim 1, wherein by applying an external force to the nodes of the U-shaped members of the two recessed buffer walls, openings of the U-shaped member are adjusted in size and shape.

5. The gas column structure for the shockproof sleeve of claim 1, wherein the accommodating space is located between the gas-column sheet and the two recessed buffer walls, and the number of the gas columns of the gas-column sheet is equal to the number of the U-shaped members of each said recessed buffer wall, so that the accommodating space is formed into said semi-open accommodating space.

6. The gas column structure for the shockproof sleeve of claim 1, wherein each of the U-shaped members is composed of the three short gas columns and the two nodes alternately connected in series, and each two adjacent said short gas columns are heat sealed together with a said node therebetween.

7. The gas column structure for the shockproof sleeve of claim 3, wherein an additional gas-column sheet is connected to a respective said recessed buffer wall at the second folding line, the additional gas-column sheets being configured to be pulled down and positioned above the accommodating space to allow the shockproof sleeve to provide double protection.

8. The gas column structure for the shockproof sleeve of claim 7, wherein in the additional gas-column sheet, the number of gas columns thereof is equal to the number of the U-shaped members of one said recessed buffer wall.

9. The gas column structure for the shockproof sleeve of claim 1, wherein a additional dark gas-column sheet is attached to at least one of the folding lines of the recessed buffer walls by means of heat sealing so that the dark gas-column sheet serves as a movable screen for covering and thereby protecting the semi-open accommodating space.

10. The gas column structure for the shockproof sleeve of claim 9, wherein the dark gas-column sheet has gas columns presented in a number equal to a number of the U-shaped members.

11. The gas column structure for the shockproof sleeve of claim 9, wherein the gas columns of the gas-column sheet are formed into irregular shapes when arranged into connected, abreast said gas columns through heat sealing, so that the gas columns are less likely to be pricked by any sharp point of an article received in the shockproof sleeve.

12. The gas column structure for the shockproof sleeve of claim 11, wherein as the columns of the gas-column sheet are formed into irregular shapes, sites where sealing lines are formed between adjacent said gas columns are depressed from the gas columns and are ideal to receive the sharp points of the article, thereby holding the article firmly in the accommodating space.

* * * * *